US007804403B2

(12) United States Patent
Chantelou et al.

(10) Patent No.: US 7,804,403 B2
(45) Date of Patent: Sep. 28, 2010

(54) SECURITY SYSTEM CONTROL MODULE

(75) Inventors: Olivier Chantelou, Valbonne (FR); Laurent Legris, Auribeau sur siagne (FR); Francois Kaag, Mouans Sartoux (FR)

(73) Assignee: Honeywell International Inc., Morristown, NJ (US)

( * ) Notice: Subject to any disclaimer, the term of this patent is extended or adjusted under 35 U.S.C. 154(b) by 290 days.

(21) Appl. No.: 12/136,118

(22) Filed: Jun. 10, 2008

(65) Prior Publication Data

US 2008/0316024 A1 Dec. 25, 2008

Related U.S. Application Data

(60) Provisional application No. 60/943,227, filed on Jun. 11, 2007.

(51) Int. Cl.
*G08B 1/08* (2006.01)

(52) U.S. Cl. ..... 340/539.1; 340/539.16; 340/531

(58) Field of Classification Search ..... 340/539.1, 340/539.16, 539.18, 531, 539.22, 3.1; 379/93.01, 379/93.05; 455/404.1; 700/19
See application file for complete search history.

(56) References Cited

U.S. PATENT DOCUMENTS 6,243,010 B1 * 6/2001 Addy et al. ..... 340/539.16
6,661,340 B1 * 12/2003 Saylor et al. ..... 340/539.22
7,113,106 B2 * 9/2006 Sendrowicz ..... 340/870.02
7,174,176 B1 * 2/2007 Liu ..... 455/404.1
7,248,157 B2 * 7/2007 Bergman et al. ..... 340/531
2004/0260407 A1 * 12/2004 Wimsatt ..... 700/19
2005/0210532 A1 9/2005 Winick
2006/0132301 A1 6/2006 Stilp
2008/0122575 A1 * 5/2008 Lavian et al. ..... 340/3.1
2010/0097210 A1 * 4/2010 Tyroler et al. ..... 340/540

* cited by examiner

*Primary Examiner*—John A Tweel, Jr.
(74) *Attorney, Agent, or Firm*—Barkume & Associates, P.C.

(57) ABSTRACT

A security system control module with a portable housing including a wireless receiver, control circuitry, nonvolatile memory, and a data connector. The receiver receives data transmissions from at least one wireless security device that monitors a condition of a premises in which the wireless security device is installed. The data connector exchanges data between the control circuitry and an external host device, and it also accepts from the external host device primary operating power for operating the wireless receiver, the control circuitry, and the nonvolatile memory. The control circuitry is adapted to process signals in accordance with a preprogrammed configuration file stored in the nonvolatile memory, the signals received via the wireless receiver from a wireless security device, and to communicate with an external computer located remotely from the external host device via the data connector using a first communications protocol.

11 Claims, 2 Drawing Sheets

SECURITY SYSTEM CONTROL MODULE

CROSS-REFERENCE TO RELATED APPLICATIONS

This application claims the benefit and filing priority of U.S. application 60/943,227 filed Jun. 11, 2007.

TECHNICAL FIELD

This invention relates to security systems for monitoring a premises, and in particular to a portable wireless control module that can be interconnected to a networked device such as a desktop computer, network router or the like to provide the functionality of a control panel such as an alarm an system status reporting over the network.

BACKGROUND OF THE INVENTION

A wireless security system includes various security system devices such as keypads, keyfobs, sensors, smoke alarms and sounders that are controlled by a control panel via wired or wireless communications. This control panel transmits alarm signals to central station centers and exchanges configuration data with this center. The alarm signals transmitted by a control panel may consist of information on detection of motion, detection of a door opening, detection of shock, etc. The alarm signals could also include with the detection information image, video or audio signals recorded by the various detectors to confirm the alarm.

Control panels in the prior art are usually large, and installation usually involves locating the panel on a wall and then making connections to AC power and to the telephone line. Typically, alarm information would be sent to the central station via the telephone line in order to report an alarm condition, as well known in the art. Then, the configuration of the control panel involves programming through the keypad or the connection of a configuration tool such as a personal computer on which panel-specific software will be executed to program the panel. These operations take an extensive amount of time and require various hardware tools.

While the typical alarm system in the prior art utilized the telephone line as a primary means of communicating with the central station, many locations in which alarm systems are being installed may not have a conventional POTS (plain old telephone system) line in place. For example, rather than using the conventional analog lines, many users may opt for cell phones or VOIP (voice over Internet protocol) service, which does not require the conventional telephone line. This makes installation of a prior art control panel problematic.

It is therefore desired to implement the control panel functionality without the time and expense normally required for installing conventional control panel.

It is also desired to implement the control panel functionality without requiring a conventional telephone line available for communications with a central station operator.

The present invention is a new implementation of a control panel module of a wireless security system with minimal installation.

DISCLOSURE OF THE INVENTION

The present invention is a security system control module that has a portable housing that includes a wireless receiver, control circuitry coupled to the wireless receiver, a nonvolatile memory coupled to the control circuitry, and a data connector coupled to the control circuitry. The wireless receiver receives wireless data transmissions from at least one wireless security device that monitors a condition of a premises in which the wireless security device is installed (such as a PIR device, a smoke detector, a surveillance camera, etc). The data connector exchanges data between the control circuitry and an external host device, and it also accepts from the external host device primary operating power for operating the wireless receiver, the control circuitry, and the nonvolatile memory. The control circuitry is adapted to process signals in accordance with a preprogrammed configuration file stored in the nonvolatile memory, the signals received via the wireless receiver from a wireless security device, and to communicate with an external computer located remotely from the external host device via the data connector using a first communications protocol.

The preprogrammed configuration file may be programmed into the nonvolatile memory by connecting the security system control module to a programming computer (such as a desktop personal computer) and executing a configuration program on the programming computer. The configuration file includes registration information for at least one wireless security device to authorize the module to communicate with the wireless security device.

In another aspect of the invention, a security system is provided that includes the security system module described above, and further includes an external host device interconnected to the security system module via the data connector. The external host device communicates with the security system module using the first communications protocol, and the external host device also communicates over a network with a remote computer via a second communications protocol to transmit security system data from the security system module to the remote computer (and to transfer security system data to the security system module from the remote computer). For example, the first communications protocol may be a serial protocol such as the USB (Universal Serial Bus) protocol and the second communications protocol may be a packet data protocol such as TCP/IP. Note that in this example the TCP/IP information and data format transported from the host to the remote computer are already provided in the USB protocol. The external host device may be a personal computer, but it may in the alternative be a device such as a network router.

The security system module of the present invention may also have a battery within the housing for supplying secondary operating power to the wireless receiver, the control circuitry, and the nonvolatile memory in the event that primary operating power is no longer received from the external host device. The security system module may then also include a local wireless transmitter coupled to the control circuitry within the housing, which will transmit an alarm signal to an external sounder device in the event that primary operating power is no longer received from the external host device. In the alternative, the module may include a wireless network transmitter coupled to the control circuitry within the housing, which will transmit an alarm signal to an external wireless network access point (e.g. WIFI or GPRS) in the event that primary operating power is no longer received from the external host device.

Accordingly, the present invention provides for a small, portable, easily-installable control device that can interface with existing wireless security system devices and communicate with the central station via a host device operating over a networked connection with the central station, obviating the requirement for interconnecting with a conventional telephone line.

BEST MODE FOR CARRYING OUT THE INVENTION

Figure 1:
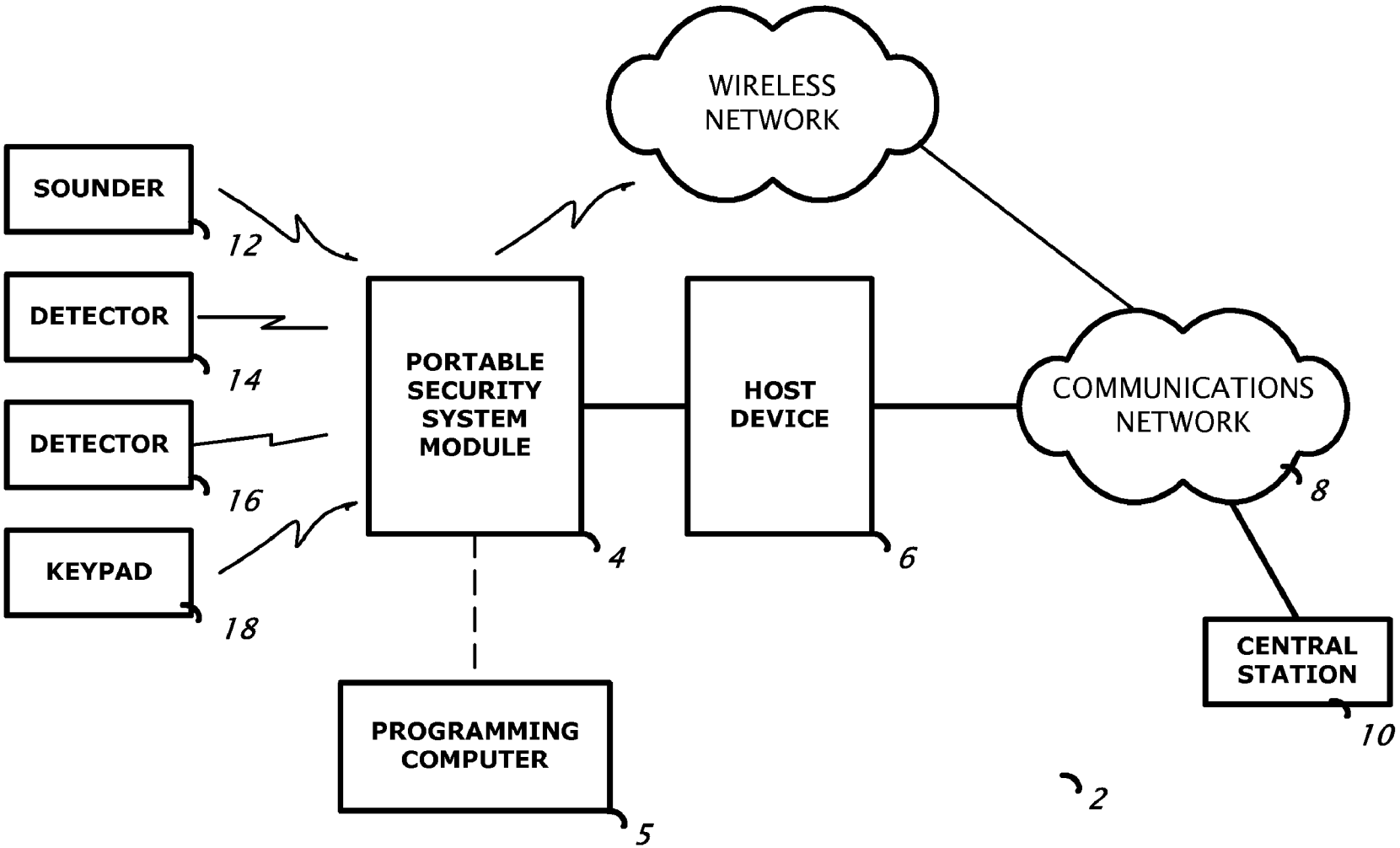
FIG. 1 is a block diagram of the system of the preferred embodiment of the present invention.

According to this invention, and with respect to FIG. 1, the security system control panel module of the preferred embodiment of the present invention is a relatively small, portable module 4 that is plugged directly into a communications connector of an external host device 6 that also provides primary operating power to the module 4. Typical examples of such connections could be a USB connector or an Ethernet connector on a PC, an IP router, an ADSL modem or a fiber optic termination interface. The control panel module 4 does not include any user interface, except in some cases an LED indicating that it is powered and/or otherwise operational.

Also shown in FIG. 1 are various security system devices as known in the art, such as sounder 12, detector 14 which may be for example a PIR sensor, detector 16 which may be for example a smoke detector, and a keypad 18. These wireless devices may be easily installed by placing them in the desired locations, and operate in wireless fashion with the portable security system module 4 in the same manner as if they were interoperating with a prior art control panel. That is, each of these wireless security devices are adapted to monitor a condition of the premises and send data signals to the module 4 indicative of their status and the like.

Also shown in FIG. 1 is a programming computer 5, which may or may not be the same device as the host device 6. The programming computer is used by an installer to configure the module 4 as which is described in further detail below. Also shown in FIG. 1 are a communications network 8, which may for example be a wide area network such as the Internet, which allows communications with the central station 10. This enables the system to eliminate reliance on conventional telephone line communications as in the prior art. A wireless network is also shown, which may provide an alternative communications methodology in the event the module 4 is unable to communicate via the host device 6.

Figure 2:
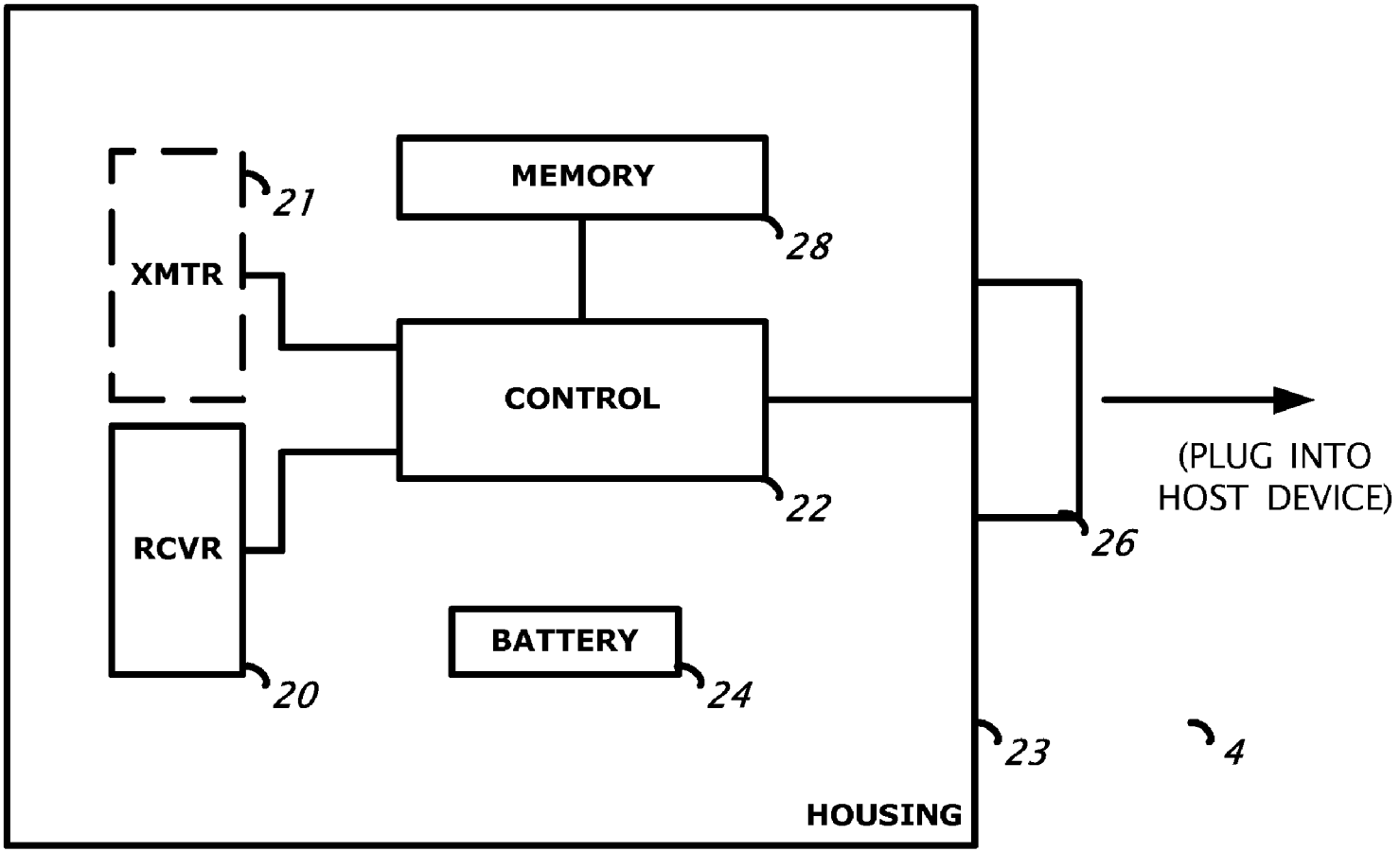
FIG. 2 is a block diagram of the portable security system control module of FIG. 1.

Further detail of the security system module 4 is provided in FIG. 2. The module consists of a small, portable housing 23, which holds a wireless receiver 20, a control circuitry 22 such as a microprocessor or the like, a nonvolatile memory 28, a data connector 26, and a battery 24. Optionally a transmitter 21 may be included, or if desired the functions of the receiver 20 and the transmitter 21 may be combined into a transceiver as known in the art.

When equipped with a USB (or similar type of connection 26), the function of the module 4 depends on the host device 6 function. If the host device 6 does not communicate directly or via a local LAN to a public telecommunications network 8 (such as IP, cellular, GSM or PSTN network), the panel module 4 according to this invention will only be a standalone (i.e. "bells only") product.

If the host device 6 includes communications to telecom network 8 using IP technology, the panel module 4 could then report alarms to a central station 10 through the host device 6. In case of USB, the host device 6 could for instance have an Ethernet over USB profile that will allow direct IP reporting.

Additionally the host device 6 could have a software application that will interface the panel module 4 to provide more alarm reporting functions such as multiple paths or management function of the panel.

The control panel module 4 includes a nonvolatile memory 28 to store configurations. In order to be configured, the panel 4 is connected to a programming computer 5 (which may or may not be the host device 6) having a user interface, for instance but not limited to a personal computer. In case of a personal computer, a specific configuration software program is activated in the PC to create a user interface application to configure the module 4. The configuration may include registering the detectors 14,16, the keypads 18, and the sounders 12 into the module 4 so that the module will communicate only with these registered devices. It may also include exit delay times, entry delay times, as well as the IP addresses for alarm reporting. Once entered into the module 4, these configuration parameters are stored in the nonvolatile memory 28 so that when the module 4 is disconnected from the programming computer 5 to be connected to host device 6, the data is maintained in memory 28 and the module 4 restarts with the exact same configuration that was defined during the configuration process with the programming computer.

The configuration could also be performed via a remotely located server computer to which the module 4 will connect through the communications network 8.

The installation of the product is therefore very simple. The physical part is reduced to the connection of the control panel module 4 to the host device 6. The configuration part of the installation could be realized using software operating on the programming computer 5. As the control panel module 4 includes memory 28 to store configuration data, in the case of a USB interface connector 26 the panel module 4 could be connected to a PC 5 for configuration. Once this is done it may be disconnected from the PC 5 and connected to another host device 6—for instance an IP router, an ADSL box, or a cable set top box that will provide access to a telecom network 8.

According to the invention, the control panel module 4 implementation has been made compact and with low power consumption so that it could be powered via the connection 26. Therefore the panel module 4 includes only an interface to the host device 6, wireless communication via RF receiver 20 and nonvolatile memory 28. Any keypad 18, detector 14, 16 or sounder 12 is to communicate with the panel module 4 through radio frequency signals to the RF receiver 20.

As the products within this security system are communicating through radio frequency signals there is no reduction of the function compared to a normal security system.

The panel module 4 contains only control circuitry 22 that ensures connection to the connector of the host device 6 via connector 26, and a radio transceiver 20. The control module 22 also receives the primary operating power from the connector 26 and supplies power to the components in the module 4.

In certain cases a backup battery 24 could be used to ensure proper alarming if the power disappears from the connector 26. For instance, this alarming could be activation of the wireless sounder 12 (this may be the same sounder otherwise used when the system sounds a local alarm during normal operation). In case of power loss, the battery backup 24 will be enough to power the control circuitry and transceiver functions so that the panel module 4 can transmit an alarm or activate the sounder 12.

Therefore, the first embodiment according to this invention is a panel module 4 consisting of control circuitry 22 and a radio frequency receiver 20 that will reside into a housing 23 equipped with a USB connector 26.

Another embodiment of the invention is a panel module like the previous one with a USB connection reporting alarms through a host device such as a personal computer using Ethernet over USB protocol. Ethernet over USB allows a USB connected device (in this case the module 4) to be in communication with an external computer at central station 10 via the network 8 as if the USB device were plugged directly into the central station computer (as well known in the art). In case the Ethernet link is not available, the module function will revert to a bell only product (i.e. no connection to the central station 10.)

Another embodiment of the invention is a panel module like the previous one with USB connection reporting alarms through a host device 6 such as an IP router, an ADSL box or a cable modem host device using Ethernet over USB, the alarms consisting of simple detection alarms or of detection information combined by verification signals such as video or audio.

Another embodiment of the invention is a panel module like the two previous ones with software in the host device 6 providing additional functions of multiple reporting transmission path, management of intrusion or home automation products.

Another embodiment of the invention is a panel module like the previous one with an Ethernet/RJ45 connection instead of the USB.

Another embodiment of the invention is a panel module like the previous ones with TCP/IP protocol running over the connector and or over the communication network 8.

Another embodiment of the invention is a panel module like the previous ones with the addition of a backup battery 24 to activate a sounder 12 in case primary operating power is removed from the connector 26.

Another embodiment of the invention is a panel module like the previous ones with the addition in the software of the module of a website that could be accessed through the communication network 8 for configuration or status information. With this website running in the module, the remote or local configuration does not require any specific software.

Another embodiment of the invention is a panel module like the previous ones with the introduction into the panel 4 of a wireless transmitter 21 to a public wireless network such as GSM/GPRS, WiFi or WiMAX. this transmitter will be used by the control 22 to send alarms in the case the connection to the host device 6 is lost.

An example of the present invention is now provided. A user such as a homeowner or apartment dweller obtains the control panel module 4 and intends to use it in conjunction with the security system devices 12, 14, 16 18 as previously described. The user inserts the USB connector 26 of the module 4 into a corresponding USB port on his personal computer, which will act as the programming computer 5 to enable him to configure the module 4 as desired. The user then loads a configuration program on to the programming computer 5, which may be obtained via a CD along with the module, or online via the Internet, etc. The configuration program executes and provides the user with the ability to register ("learn") the various security system devices as well known in the art. The user may also enter various operating parameters such as premises entry time delay, exit time delay, automatic arm or disarm times, bypass modes, etc. as known in the art. The user may also enter data that will enable the module to communicate with the central station 10 such as a web address or the like.

The primary operating power for the module 4 is supplied via the connector 26 by the programming computer 5 in a manner well known in the art of USB technologies. The configuration data that is entered by the user is transferred via the USB connector 26 to the module 4, where it is stored in nonvolatile memory 28. Any other registration information that is otherwise learned by the module 4 (such as via the receiver 20) is also stored in memory 28. Once configuration is complete, the user may disconnect the module 4 from the programming computer 5, and the primary operating power is removed accordingly. However, since the data is stored in nonvolatile memory, it is not lost on removal of power.

The user may then interconnect the module 4 to the desired host device 6. In one embodiment the host device 6 is the same device as the programming computer 5, so no removal/insertion is necessary. Alternatively, the host device 6 may be a network connected IP router that has a USB port suitable for interoperating with the module 4. So, if the user has a router as part of a local area network, he may insert this device into the router in order for it to communicate over the network as desired. In the alternative to a USB connection, an Ethernet connector (or other) may be used with a short jumper cable if required.

Regardless of the type of host device 6, the operation of the module will be essentially the same. The security devices will communicate with the module 4 via the receiver 20, and the control circuitry will assemble data messages to be transmitted (in accordance with the configuration file in memory 28) to the central station operator.

The data messages are sent to the host device 6 via the connector 26 in a first communications protocol, which in this example is the USB serial protocol. The host device 6 is configured to translate the messages to a second protocol so it may communicate with the central station computer over the network 8 (such as the Internet) in TCP/IP, which is the second protocol. Likewise, data may be transmitted from the central station computer 10 to the host device 6 in TCP/IP, then translated to serial USB format, then transferred over the connector 26 back to the module 4.

What is claimed is:

1. A security system control module comprising:

a. a portable housing;

b. a wireless receiver within the housing, the wireless receiver adapted to receive wireless data transmissions from at least one wireless security device adapted to monitor a condition of a premises in which the wireless security device is installed;

c. control circuitry coupled to the wireless receiver within the housing;

d. nonvolatile memory coupled to the control circuitry;

e. a data connector coupled to the control circuitry for exchanging data between the control circuitry and an external host device, and for accepting from the external host device primary operating power for operating the wireless receiver, the control circuitry, and the nonvolatile memory;

wherein the control circuitry is adapted to process signals in accordance with a preprogrammed configuration file stored in the nonvolatile memory, said signals received via the wireless receiver from a wireless security device, and to communicate with an external computer located remotely from the external host device via the data connector using a first communications protocol.

2. The module of claim 1 wherein the preprogrammed configuration file is programmed into the nonvolatile memory by connecting the security system control module to a programming computer and executing a configuration program on the programming computer.

3. The module of claim 2 wherein the configuration file comprises registration information for at least one wireless security device to authorize the module to communicate with the wireless security device.

4. A security system comprising the security system module of claim 1, and further comprising an external host device interconnected to the security system module via the data connector, the external host device communicating with the security system module using the first communications protocol, the external host device further communicating over a network with a remote computer via a second communications protocol to transmit security system data from the security system module to the remote computer and to transfer security system data to the security system module from the remote computer.

5. The security system of claim 4 wherein the first communications protocol is a serial protocol and the second communications protocol is a packet data protocol.

6. The security system of claim 5 wherein the serial protocol is USB and the packet data protocol is internet protocol.

7. The security system of claim 4 wherein the external host device is a personal computer.

8. The security system of claim 4 wherein the external host device is a network router.

9. The module of claim 1 further comprising a battery within the housing for supplying secondary operating power to the wireless receiver, the control circuitry, and the nonvolatile memory in the event that primary operating power is no longer received from the external host device.

10. The module of claim 9 further comprising a wireless transmitter coupled to the control circuitry within the housing, the wireless transmitter adapted to transmit an alarm signal to an external sounder device in the event that primary operating power is no longer received from the external host device.

11. The module of claim 9 further comprising a wireless network transmitter coupled to the control circuitry within the housing, the wireless network transmitter adapted to transmit an alarm signal to an external wireless network access point in the event that primary operating power is no longer received from the external host device.

* * * * *